US008047802B2

(12) United States Patent
Clemen

(10) Patent No.: US 8,047,802 B2
(45) Date of Patent: Nov. 1, 2011

(54) COURSE OF LEADING EDGES FOR TURBOMACHINE COMPONENTS

(75) Inventor: Carsten Clemen, Mittenwalde (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 860 days.

(21) Appl. No.: 12/149,011

(22) Filed: Apr. 24, 2008

(65) Prior Publication Data

US 2008/0286107 A1 Nov. 20, 2008

(30) Foreign Application Priority Data

Apr. 27, 2007 (DE) ..... 10 2007 020 476

(51) Int. Cl.
*F03B 3/12* (2006.01)

(52) U.S. Cl. ..... 416/238; 416/DIG. 2

(58) Field of Classification Search ..... 416/238, 416/DIG. 2
See application file for complete search history.

(56) References Cited

U.S. PATENT DOCUMENTS

| | | | | |
|---|---|---|---|---|
| 3,989,406 | A | 11/1976 | Bliss | |
| 4,969,800 | A * | 11/1990 | Parry et al. | 416/238 |
| 5,167,489 | A * | 12/1992 | Wadia et al. | 415/182.1 |
| 5,642,985 | A | 7/1997 | Spear et al. | |
| 7,108,486 | B2 * | 9/2006 | Talbotec et al. | 416/243 |
| 7,789,631 | B2 * | 9/2010 | Hoeger | 416/228 |
| 2005/0232778 | A1 | 10/2005 | Kakishita et al. | |
| 2005/0249600 | A1 | 11/2005 | Kakishita et al. | |
| 2007/0086886 | A1 | 4/2007 | Sassanelli | |
| 2007/0297904 | A1 | 12/2007 | Hoeger | |

FOREIGN PATENT DOCUMENTS

| | | |
|---|---|---|
| DE | 4344189 | 8/1995 |
| DE | 102005014870 | 11/2005 |
| DE | 102005014871 | 11/2005 |
| EP | 0661413 | 7/1995 |
| EP | 0 774 567 A1 | 5/1997 |
| EP | 1138877 | 10/2001 |

(Continued)

OTHER PUBLICATIONS

German Search Report dated Oct. 24, 2008 from counterpart German patent application No. 102007020476.2.

(Continued)

*Primary Examiner* — Edward Look
*Assistant Examiner* — Andrew C Knopp
(74) *Attorney, Agent, or Firm* — Timothy J. Klima; Shuttleworth & Ingersoll, PLC

(57) ABSTRACT

The course of the leading edges of turbomachine components, such as rotor blades and stator vanes is defined mathematically exactly and repeatedly as well as aerodynamically advantageously by the respective axial coordinate in the direction of the machine axis in relation to the blade height in percent, extending from the blade tip as per equation (1):

Figure 1:
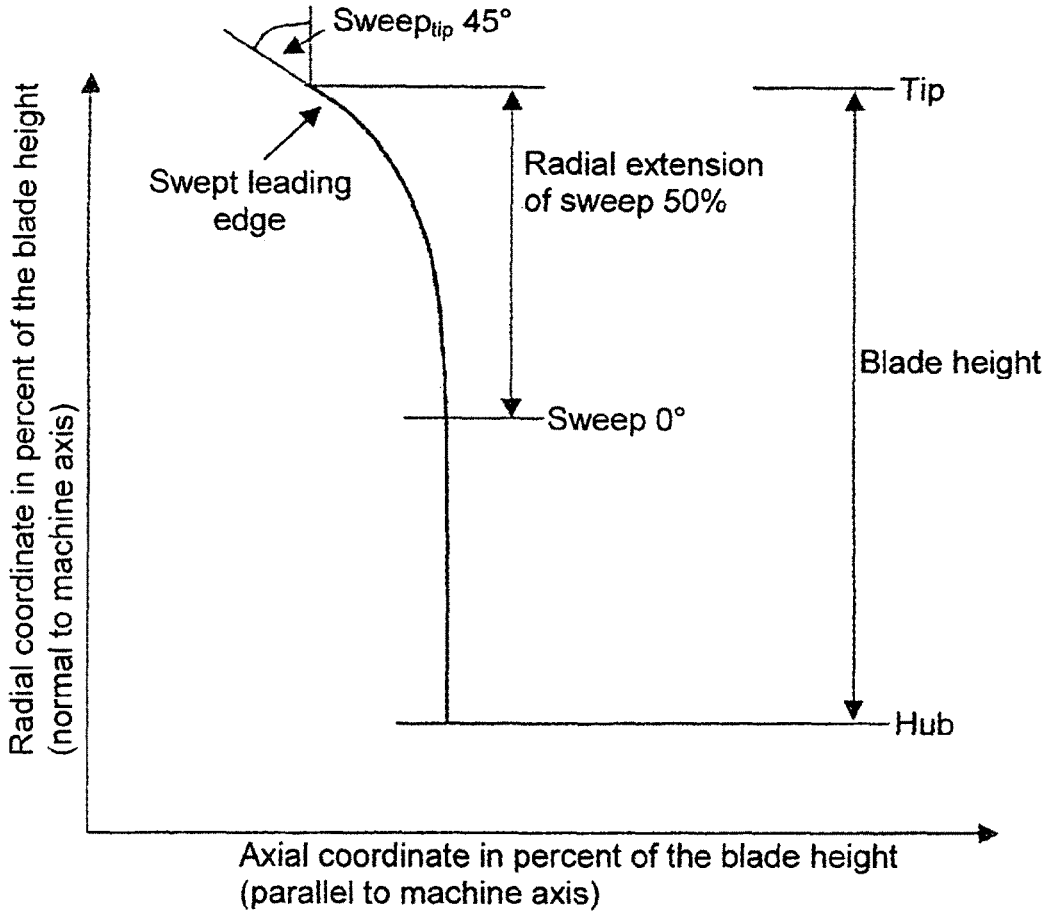

$$\text{axial coordinate [\% blade height]} = \frac{1}{5}\,\text{extension [\% blade height]}\,\tan\, sweep_{tip}\left(1 - e^{\frac{-5(100\%-blade\ height\ [\%])}{extention\ [\%\ blade\ height]}}\right)$$

and extending from the blade hub as per equation (2):

$$\text{axial coordinate [\% blade height]} = \frac{1}{5}\,\text{extension [\% blade height]}\,\tan\, sweep_{hub}\left(1 - e^{\frac{-5\ blade\ height\ [\%]}{extention\ [\%\ blade\ height]}}\right)$$

where $sweep_{tip}$ or $sweep_{hub}$, respectively, represents the sweep angle at the tip or at the hub, determined in accordance with the operating conditions, and the extension represents the height of the blade in percent, by which the sweep angle departs from 0° relative to the coordinate extending normal to the axial coordinate.

4 Claims, 2 Drawing Sheets

FOREIGN PATENT DOCUMENTS

| | | | |
|---|---|---|---|
| EP | 0 801 230 | B1 | 4/2003 |
| EP | 1 111 188 | B1 | 11/2006 |
| WO | 2005054633 | | 6/2005 |
| WO | 2005088135 | | 9/2005 |

OTHER PUBLICATIONS

European search report dated Oct. 19, 2010 for counterpart patent application.

* cited by examiner

COURSE OF LEADING EDGES FOR TURBOMACHINE COMPONENTS

This application claims priority to German Patent Application DE102007020476.2 filed Apr. 27, 2007, the entirety of which is incorporated by reference herein.

This invention relates to the swept course of the leading edges for turbomachine components, such as rotor blades, stator vanes, fan blades or propellers.

The generally known curved course of the leading edges of the rotor blades and stator vanes of compressors and turbines of turbomachinery, for example a gas-turbine engine, is—unsystematically—determined by applying the leading edge sweep on the basis of experimental values. The course of the leading edge is defined, on the basis of the experience of the designer, by the axial coordinate (direction of machine axis) related to several radial coordinates over the blade height. Accordingly, the course of the leading edge is not defined by continuous mathematical functions so that, due to discontinuities (steps) in the run of the curve, the flow at the leading edge will be unsteady and boundary layer separation and flow losses may occur. While the steps can be ground off, such rework will, on the one hand, affect the accuracy required of the curve established by application of leading edge sweep. On the other hand, the notch effect caused by steps in the leading edge will reduce the life of the blades or vanes. Furthermore, a systematically defined course of the leading edge enables the profile load distribution at gap-near rotor blade and stator vane sections to be specifically equalised, thus increasing efficiency and stability. It also enables the high inflow mach numbers at the fan tips to be specifically reduced, thereby providing for a reduction of sound emission.

The present invention, in a broad aspect, indicates a steady, repeatable, distinctly defined swept course of the leading edges for rotor blades, stator vanes, fans or propellers of turbomachines.

The course of the leading edge is defined starting, on the one hand, from the free tip and, on the other hand, from the firm side or hub of the turbomachine component by the position of the leading edge in a coordinate system, with the axial coordinate extending in the direction of the machine axis and the radial coordinate extending normal to the latter over the blade height, and is established at the blade tip from the relation:

$$\text{axial coordinate [\% blade height]} = \frac{1}{5}\,\text{extension [\% blade height]}\,\tan\,sweep_{tip}\left(1 - e^{\frac{-5(100\%-blade\ height\ [\%])}{extention\ [\%\ blade\ height]}}\right) \quad \text{(formula 1)}$$

that is, e is to the power of: −5 (100%−blade height [%])/(extension [% blade height]), and at the hub from the relation:

$$\text{axial coordinate [\% blade height]} = \frac{1}{5}\,\text{extension [\% blade height]}\,\tan\,sweep_{hub}\left(1 - e^{\frac{-5\ blade\ height\ [\%]}{extention\ [\%\ blade\ height]}}\right), \quad \text{(formula 2)}$$

that is, e is to the power of: −5 (blade height [%])/(extension [% blade height]), from which the applicable axial coordinate for determining the course of the leading edge is calculated for the respective blade height, in percent, in dependence of the sweep angle at the tip or at the hub, respectively, and the radial extension of the sweep, these being specified on the basis of the operating parameters of the turbomachinery. The extension of the sweep is the range of the blade height, in percent, in which the inclination of the leading edge relative to the machine axis or the axial coordinate, respectively, departs from 90° or the sweep angle is larger than 0°, respectively. Formulas 1 and 2 apply to all extensions between 0 percent and 100 percent of the blade height and to all sweep angles departing from 0°, relative to the radial coordinate. Thus, the course of the leading edge is distinctly and repeatably defined and is identical for all blades featuring the same sweep and extension. No local discontinuities at the leading edge will occur which would affect the local flow at the leading edge or would entail detrimental notch effects. Regrinding (blending) of the leading edge is therefore dispensable. The aerodynamically advantageous, continuous (smooth) course of the leading edge provides for steadiness of the flow without boundary layer separation, thus reducing losses and increasing efficiency.

The present invention is more fully described by way of a preferred embodiment. In the drawings, FIG. 1 is a schematic representation showing the definition of the swept course of the leading edge of a rotor blade in a coordinate system, and FIG. 2 shows by way of example three swept leading edge courses at a free blade end, having equal sweep angles, however featuring different sweep extension each.

Figure 2:
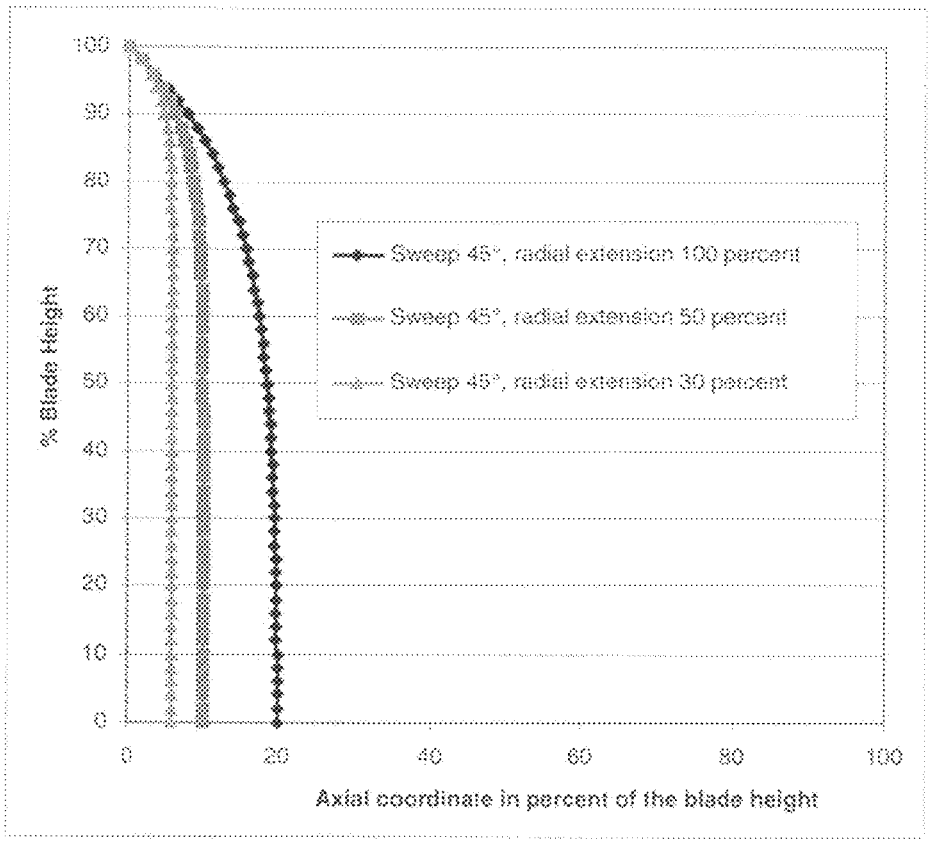

FIG. 1 shows a leading edge of a rotor blade for a turbomachine which extends over the blade height from the tip to the hub, with a swept leading edge starting at the blade tip, in a coordinate system with an axial coordinate (in percent of the blade height) extending parallel to the axis of the turbomachine axis and with a radial coordinate (in percent of the blade height) extending normal to the axial coordinate. The drawing also shows the sweep angle at the blade tip—exemplified here with 45°—i.e. the $sweep_{tip}$ and the radial extension of the sweep extending from the blade tip in percent of the blade height. The extension of the sweep is defined as the range over the blade height in which the sweep angle (the sweep) departs from 0°, i.e. the inclination of the leading edge relative to the axis of the turbomachine is not 90°. To determine the course of the leading edge extending from the hub, analogous parameters are used, i.e. the sweep angle at the hub ($sweep_{hub}$) and the radial extension of the $sweep_{hub}$ from the hub to the sweep angle 0°.

To establish the course of the leading edge, the sweep at the tip or hub, respectively, is determined on the basis of experimental values. In an aerodynamically advantageous way the sweep is about 40°, but can be significantly lower for strength reasons, normally ranging between 20 and 40°. Furthermore, the extension of the sweep from the blade tip or hub, respectively, to the sweep angle 0° is defined. Usually, a sweep starting at the tip or hub extends over a range of 40 to 60 percent of the blade height.

The axial coordinate (in percent of the blade height) of the course of the leading edge starting at the tip is allocated to a certain blade height (in percent) and established by:

$$\text{axial coordinate [\% blade height]} = \frac{1}{5}\,\text{extension [\% blade height]}\,\tan\,sweep_{tip}\left(1 - e^{\frac{-5(100\%-blade\ height\ [\%])}{extention\ [\%\ blade\ height]}}\right)$$

that is, e is to the power of: −5 (100%−blade height [%])/(extension [% blade height]) (formula 1).

The course of the leading edge at the hub is established by:

$$\text{axial coordinate [\% blade height]} = \frac{1}{5}\,\text{extension [\% blade height]}\,\tan\,sweep_{hub}\left(1 - e^{\frac{-5\ blade\ height\ [\%]}{extention\ [\%\ blade\ height]}}\right)$$

that is, e is to the power of: −5 (blade height [%])/(extension [% blade height]) (formula 2).

FIG. 2 shows three different leading edge courses established by formula 1, each starting at the tip of a rotor blade, having an equal sweep of 45°, but different extension, namely 100 percent, 50 percent and 30 percent. Given these or other parameters, the respective course of the leading edge is distinctly and repeatably defined. The course of the leading edge starting at the hub is, likewise, defined by formula 2 and sweep and extension parameters given on the basis of experimental values. Finally, the definition of the course of the leading edge as provided herein is also applicable to other turbomachine components, such as stator vanes, fan blades or propellers.

The course of the leading edge is defined mathematically, not randomly in dependence of the individual experience of the designer, as a result of which it is exactly repeatable. No local discontinuities in the course of the leading edge can occur, so that the leading edge is aerodynamically optimally designed, without requiring costly rework.

What is claimed is:

1. A bladed turbomachine component comprising a leading edge and a blade height extending from a hub to a tip, wherein a course of the leading edge has a sweep angle [°] at the tip and at the hub, wherein an extension of sweep, given as a percent [%] of the blade height, defines a range where the sweep angle departs from 0°, wherein the course of the leading edge is determined by a respective axial coordinate in a direction of a machine axis relative to the blade height in percent and extends from a free side/tip of the turbomachine component, and is defined by a relation:

$$\text{axial coordinate [\% blade height]} = \frac{1}{5}\,\text{extension [\% blade height]}\,\tan\,sweep_{tip}\left(1 - e^{\frac{-5(100\%-blade\ height\ [\%])}{extention\ [\%\ blade\ height]}}\right)$$

whereas the course of the leading edge extending from a hub/firm side of the turbomachine component is defined by a relation:

$$\text{axial coordinate [\% blade height]} = \frac{1}{5}\,\text{extension [\% blade height]}\,\tan\,sweep_{hub}\left(1 - e^{\frac{-5\ blade\ height\ [\%]}{extention\ [\%\ blade\ height]}}\right).$$

2. The bladed turbomachine component of claim 1, wherein the extension from the tip or the hub ranges between 40 percent and 60 percent of the blade height.

3. The bladed turbomachine component of claim 2, wherein the sweep angle ranges between 20 degrees and 40 degrees.

4. The bladed turbomachine component of claim 1, wherein the sweep angle ranges between 20 degrees and 40 degrees.

* * * * *